United States Patent [19]

Aidlin et al.

[11] Patent Number: 4,765,119

[45] Date of Patent: Aug. 23, 1988

[54] SCREW CAPPING MACHINE WITH VERTICALLY RECIPROCABLE CONTAINER PLATFORM

[75] Inventors: Samuel S. Aidlin; Stephen H. Aidlin; Larry Kincaid, all of Sarasota, Fla.

[73] Assignee: Aidlin Automation Corp, Bradenton, Fla.

[21] Appl. No.: 931,178

[22] Filed: Nov. 14, 1986

[51] Int. Cl.[4] ..... B67B 3/06; B65B 7/28

[52] U.S. Cl. ..... 53/308; 53/317; 53/368

[58] Field of Search ..... 53/308, 306, 317, 331.5, 53/368

[56] References Cited

U.S. PATENT DOCUMENTS

| | | | |
|---|---|---|---|
| 1,140,832 | 5/1915 | Jungnickel et al. | 53/308 X |
| 1,278,829 | 9/1918 | Beck | 53/368 |
| 1,296,810 | 3/1919 | Kappelhoff | 53/368 |
| 1,592,008 | 7/1926 | Sharp | 53/368 X |
| 1,814,386 | 7/1931 | Hill | 53/368 X |
| 2,126,942 | 8/1938 | Barnby | 53/317 X |
| 2,202,302 | 5/1940 | Sickel | 53/317 X |
| 2,338,852 | 1/1944 | Hohl et al. | 53/317 X |
| 2,340,106 | 1/1944 | Clark, Jr. | 53/308 X |
| 3,771,284 | 11/1973 | Boeckmann et al. | 53/317 X |

FOREIGN PATENT DOCUMENTS 735444 8/1955 United Kingdom .

*Primary Examiner*—Horace M. Culver

*Attorney, Agent, or Firm*—Dominik, Stein, Saccocio & Reese

[57] ABSTRACT

A machine for threadably engaging a supply of screw caps onto the threaded neck of a supply of containers, comprising in combination: said intermediate turret plate including at least one pocket for receiving the container; means for sequentially infeeding the containers into said container pocket of said intermediate turret plate; at least one chuck spindle mounted relative to said upper turret plate in concentric alignment with said container pocket of said intermediate turret plate, said chuck spindle including a rotatable, non-reciprocable shaft journaled relative to said bracket and a cap chuck rigidly secured to a lower end of said shaft in concentric alignment with said container pocket and said chuck spindle; means for rotating said shaft of said chuck spindle; means for sequentially infeeding the screw caps into said chuck; at least one container platform positioned concentrically below said container pocket of said intermediate turret plate to provide seating for said container; means for vertically reciprocatably mounting said container platform relative to said turret assembly and rail means affixed to the table in alignment with said container platform for relative engagement therewith to raise said container platform to a higher level, allowing the threading of the screw cap secured in said chuck onto the threaded neck of the container.

7 Claims, 2 Drawing Sheets

SCREW CAPPING MACHINE WITH VERTICALLY RECIPROCABLE CONTAINER PLATFORM

BACKGROUND OF THE INVENTION

1. Field of the Invention

This invention relates to a machine for applying a screw cap to a container. More particularly, this invention relates to high speed capping machines in which a screw cap is screwed onto the threaded neck of a container.

2. Description of the Background Art

Presently, there exist several basic types of capping machines utilized in the packaging machinery industry. The most prevalent type of capping machine is commonly referred to as "continuous rotary motion screw cappers". These rotary motion screw cappers typically consist of a main turret, or carousel, having a plurality of rotary and vertically reciprocating chuck spindles positioned about the periphery of the main turret. A supply of screw caps, properly oriented, are fed into a cap star wheel whose pockets are positioned in tangential alignment with the chuck spindles. Similarly, a supply of containers, having been filled with the product to be packaged, is fed into a container star wheel and then transferred into a main star wheel whose pockets are positioned in concentric alignment with the chuck spindles of the main turret. During operation, the chuck spindles sequentially engage and lift a screw cap from the cap star wheel and then, upon further rotation of the main turret, the chuck spindles are spun and moved downwardly until the screw caps engage the threaded neck of the container. As each screw cap has been properly torqued, the chuck spindle is moved upwardly, and the cycle is repeated. To accomplish proper torquing, the chuck usually either consists of a friction clutch device which begins to slip when proper torque is obtained or a cocked spring or torque-sensitive trigger mechanism having jaws which snap open to release the cap when the preset torque is obtained.

It is noted that the requirement that the chuck spindles vertically reciprocate significantly contributes to the complexity of the screw capping machine. One attempt known to Applicants to reduce the vertical reciprocating travel of the chuck spindle is disclosed in British Patent Specification No. 735,444, published Aug. 24, 1955, and entitled "Improvements and/or Relating to Arrangements for Spinning Caps on Cylindrical Objects Such a Bottles". In said British patent specification, there is disclosed a vertically reciprocating plunger on which rests the containers to be capped. During operation, the plunger is forced vertically into engagement with the spinning chuck spindle for engagement with the screw cap to be threaded onto the threaded neck of the container. Further upward movement of the plunger then forces the chuck spindle vertically upward to properly torque the screw cap onto the threaded neck of the container. Russian Pat. No. 721,371, published Mar. 15, 1980, discloses a pivotable-type plunger which forces the container upwardly for engagement into the chuck spindle while allowing the plunger to slightly pivot or tilt when the neck of the container engages the chuck spindle.

From the foregoing, it should be appreciated that there exists a need in the bottle capping industry for a bottle capping machine which does not require vertical reciprocating motion of the chuck spindles during the entrainment or pick up of the screw caps or during the threading of the screw cap onto the threaded neck of the container. Such a need, if satisfied, would significantly reduce the complexity of the screw capping machine and result in increased throughput and reliability, all at a reduced cost to the packager.

Therefore, it is an object of this invention to provide an apparatus and a method which overcomes the aforementioned inadequacies of the prior art devices and methods and provides an improvement which is a significant contribution to the advancement of the screw capper art.

Another object of this invention is to provide a screw capper for screwing a screw cap onto the threaded neck of the container by means of a non-reciprocating chuck spindle.

Another object of this invention is to provide a screw capper which is operable at relatively high speeds to enhance the throughput of the machine at a cost savings.

Another object of this invention is to provide a screw capper for screwing a screw cap onto the threaded neck of a container in which only the screw caps and the containers are moved vertically upward for engagement into the chucks of the chuck spindles of the screw capper.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises an apparatus and a method for threadably engaging a screw cap onto the threaded neck of a container. More particularly, the apparatus of the invention basically comprises a turret assembly which successively threadably mates a supply of screw caps with the threaded necks of a supply of containers. The turret assembly comprises a plurality of equally spaced pockets for sequentially receiving a supply of containers from a container star wheel as is conventional within the industry. Further, the turret assembly includes a conventional discharge star wheel and associated mechanisms to sequentially discharge the containers from the pockets of the turret assembly after the containers are screw capped in accordance with the subject invention.

In this regard, a plurality of chuck spindles are concentrically positioned above each of the container pockets of the turret assembly. Each chuck spindle comprises a cap chuck which is rotatively journaled to the turret assembly and driven simultaneously and continuously with one another by means of a continuous flexible member such as a chain or a belt or by means of gearing. Alternatively, the chuck spindle may be driven independently by individually controlled motors. However, unlike other chuck spindles known in the trade, the chuck spindles of the invention are not vertically reciprocatively mounted relative to the turret assembly. Finally, the chuck spindles further comprise an adjustable torque clutch to allow the desired torquing of the screw cap onto the container during the operation.

During operation, the supply of screw caps entrained within the cap star wheel are presented onto a ramp having one portion level with the underside of the cap star wheel and an inclined arcuate portion which functions to elevate the screw cap into the mouth of the chuck of the chuck spindle as the screw cap is forced down line by first the cap star wheel and then subsequently by partial and then fully entrainment into the chuck. Once fully entrained into the chuck of the chuck assembly, the chuck is closed by air pressure to securely retain the screw cap therein whereupon the chuck spindle moves past the end of the ramp.

After the chuck spindle fully secures the screw cap within its chuck and moves beyond the ramp, the container concentrically positioned below is moved upwardly by means of a vertically reciprocatively container platform which forces the threaded neck of the container into threaded engagement with the cap secured within the spinning chuck of the chuck spindle.

The vertically reciprocatively container platform comprises a downwardly depending spring-loaded rod having a wheel on the downward end thereof which rides against a fixed inclined arcuate rail positioned below the turret assembly. The inclined rail comprises a first portion at one level to force the platform upwardly a first distance and a second portion at a higher second level to force the container platform fully upwardly allowing the threaded neck of the container to fully engage, at proper torque, into the screw cap of the rotating chuck assembly. The spring loaded rod connected to the container platform allows compression of the container platform relative to the rod to prevent cross-threading as the rod rides upwardly onto the lower level of the rail and to assure that excessive force is not imparted by the container positioned thereon into the screw cap as the rod rides upwardly onto the second portion of the inclined rail.

The screw capping machine of the invention satisfies a long felt need in the bottling industry by eliminating the requirement for a vertically reciprocatively mounted chuck spindle. As a result, simpler chuck spindles may be utilized thereby increasing the throughput of the screw capper while decreasing the costs of constructing and maintaining the machine for production. Indeed, the chuck spindle herein disclosed of the invention comprises a simple design operable by air pressure to rigidly retain the screw cap within its chuck as the chuck is spun during the threading process.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
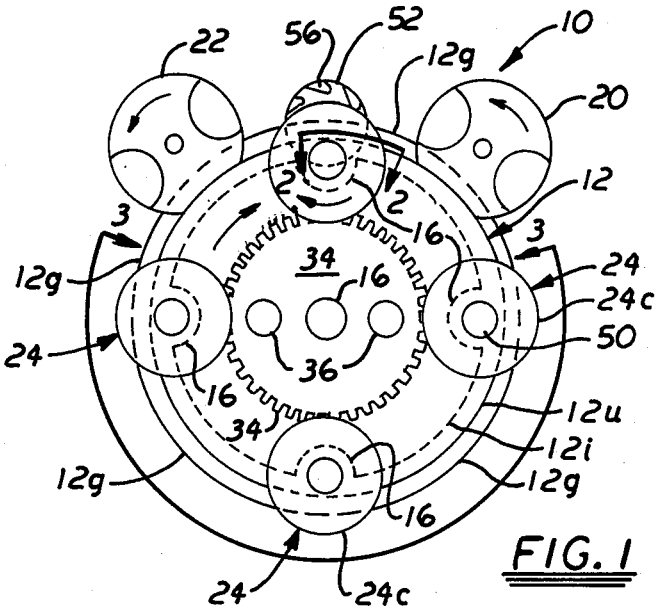
FIG. 1 is a schematic top plan of the screw capping machine of the invention illustrating the container infeed and outfeed star wheels, the main turret assembly, and the screw cap star wheel of the invention.
Figure 3:
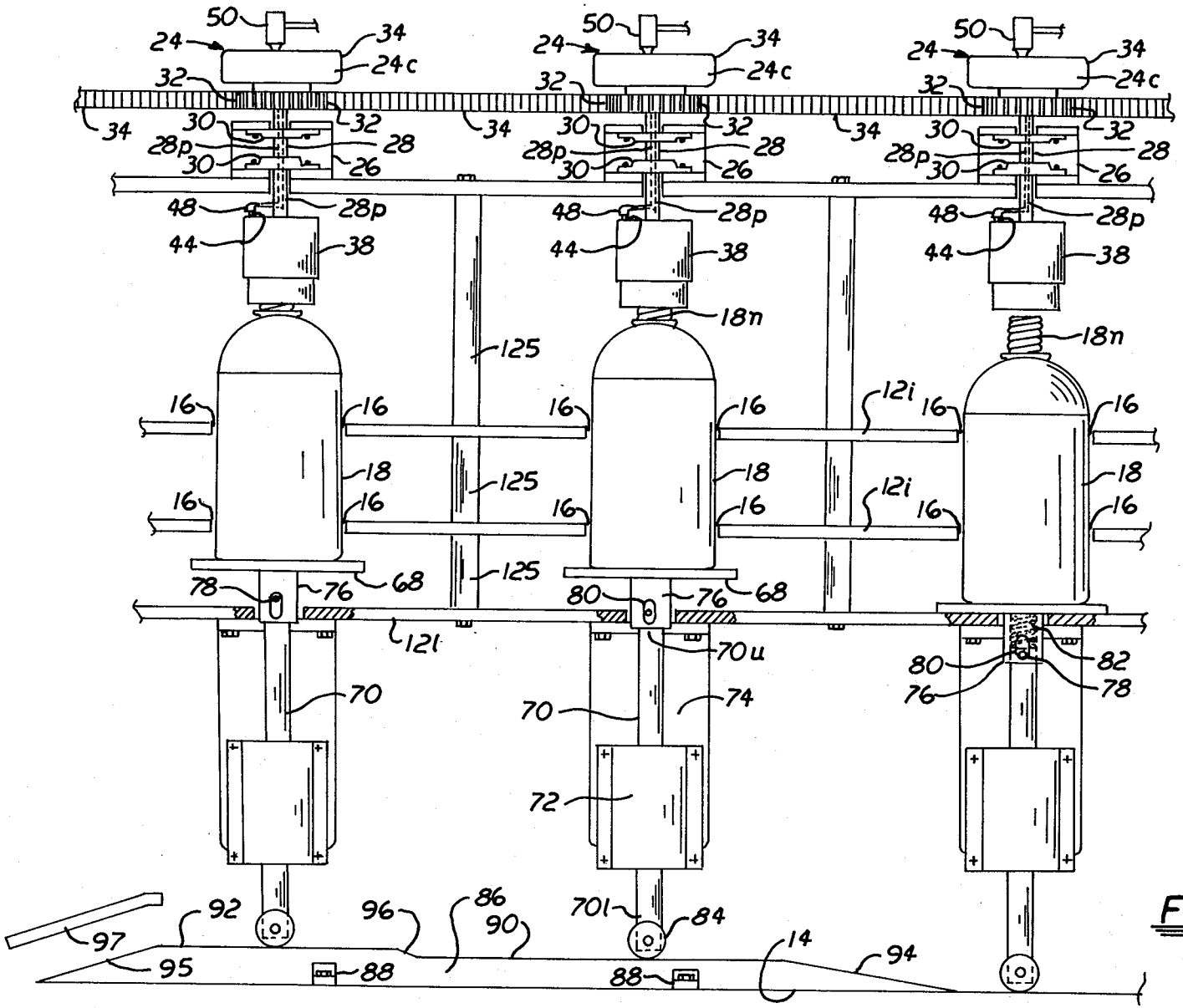
FIG. 3 is a partial side view of the turret assembly along lines 3—3 of FIG. 1 illustrating the sequential threading operation of the caps onto the threaded necks of the containers.

Referring to FIG. 1, the invention comprises a screw capping machine, generally indicated by numeral 10, having a main turret assembly 12 rotatively mounted relative to a table 14 (see FIG. 3) about a vertical axis of rotation 16. As shown in FIG. 3, the main turret assembly 12 comprises an upper and lower turret plate 12U and 12L fixedly secured together in concentric alignment with each other by means of standoff spacers 12S. Further, main turret assembly 12 comprises a pair of intermediate turret plates 12I rigidly and concentrically positioned between the upper and lower plates 12U and 12L by the standoff spacers 12S.

A plurality of equispaced container pockets or recesses 16 are formed about the periphery of the intermediate turret plates 12I to receive a supply of containers 18 from a conventional infeed star wheel generally indicated by numeral 20. Guard rail 12G retain the containers 18 in the pockets 16 as the containers 18 are transported via turret plates 12I. A conventional outfeed star wheel 22 is positioned down line of the turret assembly 12 to discharge the containers 18 after capping. Both the infeeding and the outfeeding of the containers 18 as thus described as conventional in the industry; moreover, other conventional types of infeeding and outfeeding may suffice without departing from the spirit and scope of this invention. The main turret assembly 12, and the container star wheels 20 and 22 are powered by a suitable electric motor (not shown) or the like as is conventional in the trade.

A plurality of chuck spindles 24 are mounted via bracket 26 to the top side of the upper turret plate 12U each in concentric alignment with the container pockets 16 ( see FIGS. 1 and 3). Each chuck spindle 24 comprises a central rotary shaft 28 which is journaled to the bracket 26 by means of a journal bearing 30 and which extends downwardly through an opening in the upper turret plat 12U in concentric alignment with the container pockets 16. A gear 32 is affixed to the shaft 28 allowing the shaft 28 to be rotated by a central gear 34, non-rotatably supported overhead by rods 36, as the turret assembly 12 is rotated. Consequently, it should be appreciated that the shafts 28 of the chuck spindles 24 are continuously and simultaneously rotated via shaft gear 32 mating with fixed central gear 34 as the turret assembly 12 is rotated. Moreover, central gear 34 may be moved vertically out of engagement with spur gears 32 by movement upwardly along rods 36.

A chuck 38 is rigidly secured to the downward end of each shaft 28. As shown in FIG. 2A, the preferred embodiment of each of the chucks 38 comprises a pneumatically operated chuck 38. More particularly, the preferred chuck 38 comprises an outer main housing 40 having an opened end 40E with a piston 42 reciprocatably mounted within the cavity 40C thereof. A compressible elastomer seal 44 is annularly positioned between the piston 42 and the opened end 40E of the housing 40. A pilot port 44p is formed through the wall of the housing 40 into the space between the piston 42 and the housing wall such that air pressure forced into the space caused the piston 42 to move toward the opened end 40E of the housing 40 compress the seal 44 and force the seal 44 in sealing and rigid engagement with a cylindrical object (screw cap 46) positioned within the opened end 40E of the housing.

Referring now to FIG. 3, it is seen that the chuck 38 functions to rigidly secure a screw cap 46 positioned within its opened end 40E and to spin the screw cap 46 upon rotation of the shaft 28 of the chuck spindle 24. However, it is noted that pneumatic operation of the chuck 38 is accomplished by fluidly connecting the pilot port 44p via a hose 48 to an internal shaft passageway 28P extending from a position near the lower end of the shaft 28 to a rotary fluid connector 50 connected to the upper end of the shaft 28. In this manner, the chuck 38 may be threadably connected to the lower end of the shaft 28 and allowed to rotate with the shaft 28 while still maintaining the pneumatic operation of the piston 42 of the chuck 38 via hose 48, internal passageway 28P, and rotary fluid connector 50.

Figure 2:
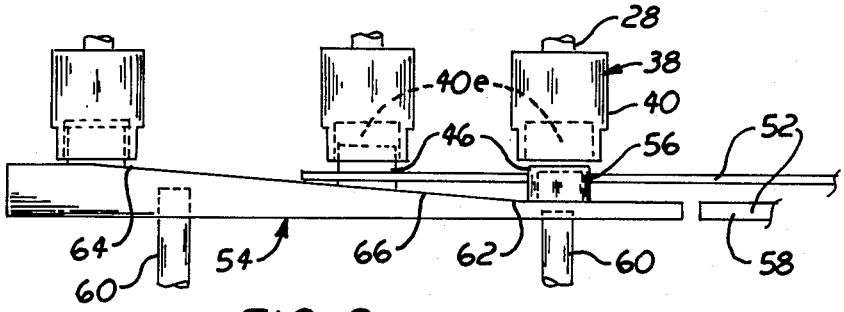
FIG. 2 is a partial side view of the turret assembly along lines 2—2 of FIG. 1 illustrating the infeed of the caps onto the inclined ramp for entrainment by the chucks of the chuck spindles of the invention.
Figure 2A:
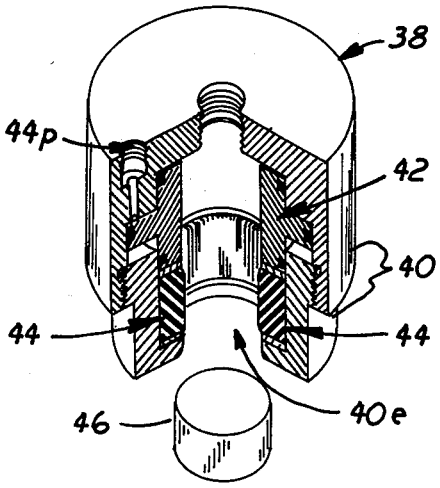
FIG. 2A is a partial cutaway view of the chuck of the invention illustrating the manner in which the chuck is pneumatically controlled to rigidly grasp the cap therein after the cap is moved into the cavity thereof by the inclined ramp.

Referring to FIGS. 1 and 2, the chucks 38 of the chuck spindles 24 sequentially receive a supply of the screw caps 46 via a cap star wheel 52 and inclined ramp 54. More particularly, cap star wheel 52 comprises a plurality of pockets 56 equispaced about its periphery which sequentially receive the screw caps 46 therein in a conventional manner. The caps 46 entrained within pockets 56 are slid along a bottom plate 58 positioned concentrically and immediately below the star wheel 52. The inclined ramp 54 is positioned at the juncture of the star wheel 52 and the main turret assembly 12 such that continued peripheral movement of the entrained caps 46 by the star wheel 52 moves the caps 46 off the bottom plate 58 at the juncture and onto the ramp 54 itself. The pockets 56 of the star wheel 52 are tangentially aligned with the chuck spindles 24 such that the caps 46 are positioned immediately below the chucks 38 when the caps 46 are deposited onto the ramp 54.

The inclined ramp 54 is rigidly affixed relative to the table 14 of the screw capping machine by means of brackets 60. The ramp 54 comprises a first portion 62 which is substantially level with the bottom plate 58 of the star wheel 52 and a second portion 64 which is higher than the first portion 62 by a distance substantially equal to the height of the caps 46. The lower first portion 62 and the higher second portion 64 are joined together by a sloped portion 66. The ramp 54 is arcuately formed to coincide with the radius of the turret assembly 12.

During operation, each cap 46 is first deposited onto the lower first portion 62 of the ramp 54 as hereinabove described. The pockets 56 of the star wheel 52 are appropriately angled to move the cap 46 slightly down line onto the sloped portion 66 of the ramp 54 to allow the aligned chuck 38 to at least partially engage the cap 46 as the cap 46 is moved further upwardly along the sloped portion 66 of ramp 54. Once the cap 46 is at least partially engaged by the respective chuck 38, the chuck 38 further slides the cap 46 along the sloped portion 66 onto the higher second portion 64 whereupon the cap 46 is fully positioned with the opened end 40E of the housing 40 of the chuck 38. The chuck 38 is then pneumatically operated to rigidly secure the cap 46 therein before the cap 46 is moved off the end of the ramp 54.

Referring now to FIG. 3, a plurality of container platforms 68 are positioned below the container pockets 16 in concentric alignment therewith. Each platform 68 is vertically reciprocatively mounted relative to the lower main turret plate 12L allowing the platforms 68 to be moved vertically upward to force the containers 18 positioned thereon upwardly until the threaded necks 18N of the containers 18 threadably engage into the caps 46 secured in the rotating chucks 38 above.

More particularly, each platform 68 is disk-shaped and reciprocatively mounted by means of a vertical rod 70 journalled through pillow block 72. Pillow block 72 is rigidly secured to a bracket 74 depending from the underside of the lower main turret plate 12L and aligned such that the rod 70 is in vertical concentric alignment with container pockets 16. The upper end 70U of the rod 70 extends into a boss 76 affixed to the underside of the platform 68 and is vertically slidably retained therein by means of a cross pin 78 transversely engaged through the upper end of the rod 70 into slots 80 positioned at opposing sides of the boss 76. A spring 82 is positioned within the boss 76 to resiliently urge the rod 70 away from the platform 68.

A rotatable wheel 84 is rotatively secured to the lower end 70L of the rod 70. An arcuate (coinciding with the radius of the turret assembly 12) cam rail 86 is fixedly connected to the surface of the turret table 14 by means of brackets 88 and is aligned with the path of the wheels 84. The cam rail 86 comprises a lower first portion 90 and a higher second portion 92. A ramp portion 94 is positioned at the beginning end of the lower first portion 90 and another ramp 96 joins the lower portion 90 with a higher portion.

An illustrated from the left of FIG. 3, the heights of the rail 86 are selected such that the rod 70 is forced upwardly a first distance equal to the height of the lower portion 90 of the rail 86 and then further upwardly a second distance equal to the height of the higher second portion 92 of the rail 86 as the wheel 84 sequentially rides onto the lower portion 90 via ramp 94 and then onto the higher portion 92 via ramp 96, respectively. Off ramp 95 and kick-down rail 97 are provided to force the wheels 84 of the rods 70 downwardly at a point beyond the higher portion 92.

From the foregoing, it should be appreciated that the threaded neck 18N of the container 18 is forced into threaded engagement with the screw cap 46 positioned within the spinning chuck 38 as the rod 70 and platform 68 are forced upwardly by wheel 86 riding onto the lower portion 90 of the rail 86. The threading of the screw cap 46 onto the neck 18N is therefore initiated while spring-loaded rod 70 prevents any cross-threading. Further movement of the turret assembly 12 then causes the platform and rod 68 and 70 to be further cammed upwardly as the wheel 84 rides onto the higher portion 92 of the rail 86 to assure that the neck 18N of the container 18 is fully threaded into the screw cap 46 at proper torque. However, the spring-loaded upper end 70U of the rod 70 into boss 76 prevents excessive force being imparted to the screw cap 46. Clutch 24C of the chuck spindle 24 begins to slip once the proper torque is imparted to the screw cap 46. After proper torquing, off ramp 95 and kick-down rail 97 returns the rod 70 to its fully downward position. Finally, the capped container 18 is then discharged from the turret assembly 12 via outfeed star wheel 22.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

What is claimed is:

1. A machine for threadably engaging a supply of screw caps onto the threaded necks of a supply of containers, comprising in combination:

a turret assembly rotatively mounted relative to a turret table including an upper turret plate, an intermediate turret plate and a lower turret plate rigidly secured together in a spaced apart relationship;

said intermediate turret plate including at least one pocket for receiving the container;

means for sequentially infeeding the containers into said container pocket of said intermediate turret plate;

at least one chuck spindle mounted relative to said upper turret plate in concentric alignment with said container pocket of said intermediate turret plate, said chuck spindle including a rotatable, non-reciprocable shaft journaled relative to said pocket and a cap chuck rigidly secured to a lower end of said shaft in concentric alignment with said container pocket and said chuck spindle;

means for rotating said shaft of said chuck spindle;

means for sequentially infeeding the screw caps into said chuck;

at least one container platform positioned concentrically below said container pocket of said intermediate turret plate to provide seating for said container;

means for vertically reciprocatably mounting said container platform relative to said turret assembly, and rail means affixed to the table in alignment with said container platform for relative engagement therewith to raise said container platform to a higher level, allowing the threading of the screw cap secured in said chuck onto the threaded neck of the container.

2. The machine as set forth in claim 1, wherein said means for mounting said container platform relative to said turret assembly comprises in combination:

a vertically depending rod affixed relative to said container platform;

a bracket rigidly affixed relative to said lower turret plate of said turret assembly;

slide bearing means affixed to said bracket of said lower turret plate allowing said rod to vertically reciprocate in alignment with said container pocket; and a wheel rotatively journaled relative to a lower end of said rod for engagement with said rail mounted to said table.

3. The machine as set forth in claim 2, wherein said rail comprises a lower first level to force said rod upwardly a first level to inititate threading of the screw cap onto the threaded neck of the container and a higher second level to force said rod further upwardly, allowing proper torquing of the screw cap onto the threaded neck of the container.

4. The machine as set forth in claim 3, further including means for resiliently connecting said rod to said container platform, allowing relative movement between said platform and said rod to prevent cross-threading of the screw cap onto the threaded neck of the container and to prevent damage being imparted to the container during torquing of the cap onto the threaded neck thereof.

5. The machine as set forth in claim 4, wherein said means for infeeding the screw caps into said chuck of said chuck spindle comprises in combination:

a cap star wheel positioned in tangential alignment with said chuck of said chuck spindle, said cap star wheel including a cap pocket for receiving the cap;

a plate affixed to the undersigned of said cap star wheel to retain the cap within said cap pocket;

a ramp positioned at a juncture between said chuck and said cap star wheel, said ramp being aligned to allow movement of the cap within said cap star wheel off of said plate onto said ramp; and said ramp including a lower first portion aligned with the level of said plate, an inclined portion, and a higher second portion substantially level with a lower surface of said chuck whereby, said cap star wheel presents the cap onto said lower first portion of said ramp from said plate and then further moves said cap upwardly along said inclined portion into concentric alignment with said chuck whereupon said chuck further moves the cap onto said higher second portion to be fully positioned within said chuck.

6. The machine as set forth in claim 5, wherein said chuck is pneumatically operated to rigidly secure the cap therein once the cap is fully positioned within said chuck and before said chuck moves beyond said higher second portion of said ramp.

7. The machine as set forth in claim 1, wherein said rotating means comprises a spur gear fixedly mounted relative to said table in geared engagement with a spur gear rigidly mounted to said shaft such that rotation of said turret assembly relative to said large spur gear causes rotation of said shaft thereby allowing threading of the cap onto the threaded neck of the container.

* * * * *